US010276104B2

(12) United States Patent
Seo et al.

(10) Patent No.: US 10,276,104 B2
(45) Date of Patent: Apr. 30, 2019

(54) DISPLAY DEVICE

(71) Applicant: SAMSUNG DISPLAY CO., LTD., Yongin-Si, Gyeonggi-Do (KR)

(72) Inventors: Won Jin Seo, Seoul (KR); Sung-In Kang, Hwaseong-si (KR); Hee-Jeong Seo, Hwaseong-si (KR); Jun Pyo Lee, Asan-si (KR)

(73) Assignee: SAMSUNG DISPLAY CO., LTD., Yongin-Si, Gyeonggi-Do (KR)

( * ) Notice: Subject to any disclaimer, the term of this patent is extended or adjusted under 35 U.S.C. 154(b) by 36 days.

(21) Appl. No.: 15/698,101

(22) Filed: Sep. 7, 2017

(65) Prior Publication Data

US 2018/0122326 A1 May 3, 2018

(30) Foreign Application Priority Data

Oct. 28, 2016 (KR) ..... 10-2016-0142204

(51) Int. Cl.
*G09G 3/3266* (2016.01)
*G09G 3/36* (2006.01)

(52) U.S. Cl.
CPC ..... *G09G 3/3266* (2013.01); *G09G 3/3674* (2013.01); *G09G 2310/0202* (2013.01); *G09G 2310/0243* (2013.01); *G09G 2310/0264* (2013.01)

(58) Field of Classification Search
None
See application file for complete search history.

(56) References Cited

U.S. PATENT DOCUMENTS 7,466,312 B2 12/2008 Choi et al.
2010/0123703 A1* 5/2010 Guo ..... G09G 3/3648 345/211
2011/0148954 A1* 6/2011 Tobita ..... G09G 3/3688 345/698

FOREIGN PATENT DOCUMENTS

KR 1020080068420 7/2008
KR 100922788 10/2009
KR 1020160077313 7/2016

* cited by examiner

*Primary Examiner* — Gene W Lee
(74) *Attorney, Agent, or Firm* — F. Chau & Associates, LLC

(57) ABSTRACT

A display device may include: a plurality of pixels; a gate driver that receives clock signals and generates and applies a plurality of gate signals to a respective plurality of gate lines connected to the plurality of pixels; and a clock signal driver. The clock signal driver may output the clock signals and receive feedback clock signals derived from the clock signals, compare the feedback clock signals, and control amplitudes of the clock signals so that an amplitude difference between the feedback clock signals is less than a threshold.

20 Claims, 7 Drawing Sheets

DISPLAY DEVICE

CROSS-REFERENCE TO RELATED APPLICATION

This application claims priority to and the benefit of Korean Patent Application No. 10-2016-0142204 filed in the Korean Intellectual Property Office on Oct. 28, 2016, the entire contents of which are incorporated by reference herein.

BACKGROUND

(a) Field

The present disclosure relates generally to display devices, and more particularly, to display devices in which clock signal characteristics are controlled.

(b) Discussion of the Related Art

A liquid crystal display (LCD), a light emitting diode (LED) display, and the like includes a plurality of pixels to display an image. The plurality of pixels are arranged in a matrix layout and are connected to a plurality of gate lines extending in a row direction and a plurality of data lines extending in a column direction. Each pixel receives a gate signal applied through the gate line and a data signal applied through the data line, synchronized with the gate signal.

SUMMARY

Exemplary embodiments of the present disclosure provide a display device that reduces amplitude differences between a plurality of clock signals applied to a gate driver due to unequal resistances in clock lines.

A display device according to an exemplary embodiment includes: a plurality of pixels; a gate driver that receives clock signals and generates and applies a plurality of gate signals to a respective plurality of gate lines connected to the plurality of pixels; and a clock signal driver. The clock signal driver may output the clock signals and receive feedback clock signals derived from the clock signals, compare the feedback clock signals, and control amplitudes of the clock signals so that an amplitude difference between the feedback clock signals is less than a threshold.

The clock signal driver may compare the feedback clock signals by comparing current or voltage values therebetween, each current or voltage value being determined at a time when an associated one of the feedback clock signals coincides with a gate-on voltage.

The clock signal driver may output the clock signals to respective clock lines at near ends thereof, and receive the feedback clock signals flowing from far ends of the clock lines. The gate driver may include a plurality of gate driver circuits each connected between one clock line and one gate line and receiving one of the clock signals at a region in between the near ends and far ends of the clock lines.

The display device may further include clock lines respectively carrying the clock signals. The clock signal driver may include: a comparison circuit configured to receive a first feedback clock signal and a second feedback clock signal from the clock lines and to compare a first current or voltage value of the first feedback clock signal and a second current or voltage value of the second feedback clock signal with each other to generate a multiplexer (MUX) control signal; a clock signal generator generating a first output clock signal; a first resistor bank including a plurality of first resistors; and a first MUX unit connecting the clock signal generator at a node providing the first output clock signal, to a first clock line of the clock lines connected to the gate driver through any one among the plurality of first resistors and a direct connection path, according to the MUX control signal, and thereby provide a first clock signal of the clock signals on the first clock line.

In the just mentioned case, the clock signal driver may generate a second output clock signal and may further include: a second resistor bank including a plurality of second resistors; and a second MUX unit connecting the clock signal generator, at a node providing the second output clock signal, to a second clock line of the clock lines connected to the gate driver through any one among the plurality of second resistors and a direct connection path, according to a second MUX control signal output from the comparison circuit, and thereby provide a second clock signal of the clock signals on the second clock line.

The second clock signal may be a clock signal of an inverted phase with respect to that of the first clock signal.

The first clock signal may be transmitted through the first clock line to be received by the comparison circuit as the first feedback clock signal derived from the first clock signal and having a current value that is dependent on a resistance of the first clock line, and the second clock signal may be transmitted through the second clock line to be received by the comparison circuit as the second feedback clock signal derived from the second clock signal and having a current value that is dependent on resistance of the second clock line.

A display device according to another exemplary embodiment of the present invention includes: a clock signal driver configured to output a plurality of clock signals; and a gate driver configured to use the clock signals to generate and apply a plurality of gate signals to a plurality of gate lines connected to the plurality of pixels. The clock signal driver may include: a memory configured to store a plurality of resistance selection values and to output, responsive to a resistor selection signal, a multiplexer (MUX) control signal based on one of the resistance selection values selected according to the resistor selection signal; a clock signal generator generating an output clock signal; a resistor bank including a plurality of resistors; and MUX circuitry routing the output clock signal to a clock line connected to the gate driver through any one among the plurality of resistors and a direct connection path, according to the MUX control signal.

The resistor selection signal may be a user initiated signal received through a user interface.

The display device may further include a line splitter coupled between the clock signal generator at a node at which the output clock signal is provided, and the MUX circuitry.

The MUX circuitry may be first MUX circuitry, the MUX control signal may be a first MUX control signal, the clock line may be a first clock line, and the direct connection path may be a first direct connection path. In this case, the clock signal driver may output a second MUX control signal and may further include: a second resistor bank including a plurality of second resistors; and second MUX circuitry connecting the clock signal generator to a second clock line connected to the gate driver through any one among the plurality of second resistors and a second direct connection path, according to the second MUX control signal.

The clock signal generator may generate a second output clock signal, and the second output clock signal may be applied to the second clock line as a second clock signal of the plurality of clock signals through any one among the plurality of second resistors and the second direct connection path by the second MUX circuitry.

The second clock signal may be a clock signal of an inverted phase with respect to that of the first clock signal. The clock signal driver may further include: a comparison circuit configured to receive a first feedback clock signal and a second feedback clock signal flowing from the first and second clock lines, respectively, and to compare a first current value of the first feedback clock signal and a second current value of the second feedback clock signal to generate a third MUX control signal and a fourth MUX control signal.

The first MUX circuitry may connect the clock signal generator to the first clock line through any one among the plurality of first resistors and the first direct connection path according to the third MUX control signal. The second MUX circuitry may connect the clock signal generator to a second clock line connected to the gate driver through any one among the plurality of second resistors and the second direct connection path, according to the fourth MUX control signal.

The memory may transmit an inactive signal to the comparison circuit if the resistor selection signal is received to inactivate the comparison circuit.

The first clock signal may be transmitted through the first clock line to be received by the comparison circuit as the first feedback clock signal having a current or voltage value that is dependent on resistance of the first clock line, and the second clock signal may be transmitted through the second clock line to be received by the comparison circuit as the second feedback clock signal having a current or voltage value that is dependent on resistance of the second clock line.

In another aspect, a display device includes clock lines carrying different respective clock signals, for application to different respective gate lines. A gate driver may be connected to the clock lines and configured to use the clock signals to generate and apply gate signals to respective gate lines connected to pixels. A clock signal driver may be configured to output the clock signals to a first region of the clock lines, receive feedback clock signals flowing from a second region of the clock lines, compare current or voltage levels between the feedback clock signals, and control amplitudes of the outputted clock signals so that a current or voltage level difference between the feedback clock signals is less than a threshold.

In the just mentioned aspect, the clock signal driver may include: comparison circuitry that compares the current or voltage levels between the feedback clock signals and outputs at least first and second control signals in accordance therewith. At least first and second variable attenuators may be coupled between the comparison circuitry and at least first and second clock lines of the clock lines, respectively. Attenuation of the first variable attenuator may be controlled according to the first control signal and attenuation of the second variable attenuator may be controlled according to the second control signal.

In various aspects of the disclosure, amplitude difference between the plurality of clock signals applied to the gate driver may thereby be reduced, and accordingly a defect in the form of a transverse line pattern appearing in the display device may be prevented.

BRIEF DESCRIPTION OF THE DRAWINGS

The above and other aspects and features of the present disclosure will become more apparent from the following detailed description, taken in conjunction with the accompanying drawings in which like reference numerals indicate like elements or features, wherein.

DETAILED DESCRIPTION

Embodiments of the present disclosure will be described more fully hereinafter with reference to the accompanying drawings. As those skilled in the art would realize, the described embodiments may be modified in various ways, all without departing from the spirit and scope of the present invention.

Herein, unless explicitly described to the contrary, the word "comprise" and variations such as "comprises" or "comprising" will be understood to mean the inclusion of stated elements but not the exclusion of any other elements.

In a related art display device, a gate driver generates a gate signal by using clock signals respectively applied through two or more clock lines. The generated gate signal may be applied to the gate lines one row at a time, so that data (converted to analog voltages) on the data lines are concurrently input to all the pixels of the row. In some arrangements, a first clock signal on a first clock line may be applied to gate drivers of a first set of gate lines, e.g. odd numbered gate lines. A second clock signal, e.g., inverted relative to the first clock signal, may be applied on a second clock line to gate drivers of a second set of gate lines, e.g., even numbered gate lines. This clock inversion technique, for example, may allow for alternating polarity voltages to be applied to alternating gate lines, which may avoid deterioration of LCD or LED characteristics.

However, the plurality of clock lines may have resistances that differ from one another by more than a prescribed amount, due to a limitation of a manufacturing process. In this case, voltage or current on one of the clock lines may differ from voltage or current on another one of the clock lines by more than a desired or requisite amount. As a result, the gate signals on the gate lines, generated by the gate drivers receiving the unequal clock signals, may deviate from an expected amplitude and/or timing. This gate signal deviation may cause a charge value of a pixel to differ between rows for a data signal of the same gray level, thereby degrading image quality. For example, an undesirable transverse line pattern may appear. Embodiments of the present disclosure described below may obviate this defect by substantially equalizing current/voltage amplitudes between clock lines. For instance, one clock signal may be attenuated relative another using a resistor to realize an effective amplitude equalization.

Figure 1:
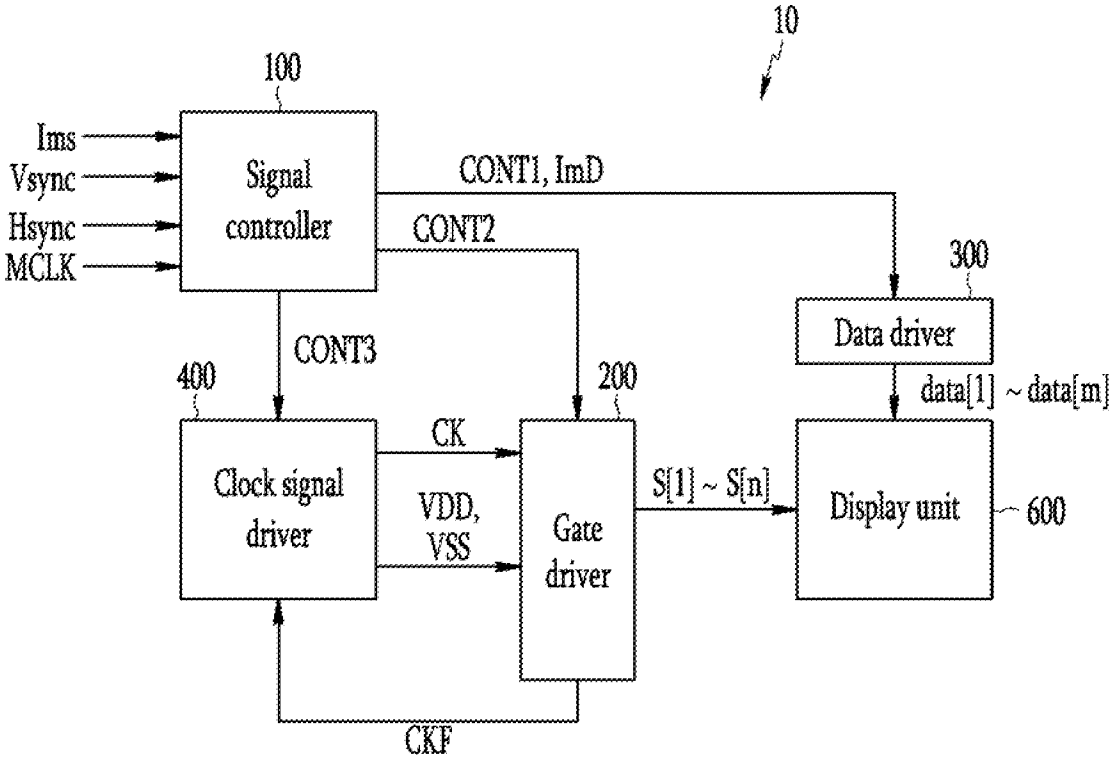
FIG. 1 is a block diagram schematically showing a display device according to an exemplary embodiment of the present disclosure.

FIG. 1 is a block diagram schematically showing a display device according to an exemplary embodiment of the present disclosure. Display device 10 includes a signal controller 100, a gate driver 200, a data driver 300, a clock signal driver 400, and a display unit 600.

The signal controller 100 receives an image signal ImS and a synchronization signal that are input from an external device. The image signal ImS includes luminance information on a plurality of pixels. The luminance has a predetermined number of gray levels, for example, $1024=2^{10}$, $256=2^{8}$, or $64=2^{6}$. The synchronization signal includes a horizontal synchronization signal Hsync, a vertical synchronization signal Vsync, and a main clock signal MCLK.

The signal controller 100 generates first to third driving control signals CONT1, CONT2, and CONT3 and an image data signal ImD according to the image signal ImS, the horizontal synchronization signal Hsync, the vertical synchronization signal Vsync, and the main clock signal MCLK.

The signal controller 100 generates the image data signal ImD by dividing the image signal ImS in frames according to the vertical synchronization signal Vsync and in rows (each driven via a gate line) according to the horizontal synchronization signal Hsync. The signal controller 100 transmits the image data signal ImD along with the first driving control signal CONT1 to the data driver 300.

The display unit 600 has a display area including a plurality of pixels. In the display unit 600, parallel gate lines substantially extending in a row direction and parallel data lines substantially extending in a column direction are formed, and connected to the plurality of pixels.

A plurality of subpixels each may emit light of one of primary colors, e.g. red, green, and blue. A desired color may be displayed with a spatial sum or a temporal sum of the primary colors. A color may be displayed by a combination of a red subpixel, a green subpixel, and a blue subpixel closely spaced to one another (e.g. horizontally or vertically). A combination of the red subpixel, the green pixel, and the blue pixel may be referred to as a pixel. Each gate line may drive a row of pixels when the subpixels of a pixel are arranged horizontally. Other subpixel layouts are also contemplated.

The gate driver 200 is connected to a plurality of gate lines, and generates a plurality of gate signals S[1]-S[n] according to the second driving control signal CONT2. The second driving control signal CONT2 may include a gate start signal STV described later with respect to FIG. 2. The gate driver 200 sequentially applies gate signals S[1]-S[n] of a gate-on voltage to the plurality of gate lines.

The data driver 300 is connected to a plurality of data lines, samples and holds an input image data signal ImD according to the first driving control signal CONT1, and transfers a plurality of data signals data[1]-data[m] to the plurality of data lines. The data driver 300 applies data signals data[1]-data[m] according to the image data signal ImD to a plurality of data lines in synchronization with a time at which one of the gate signals S[1]-S[n] becomes the gate-on voltage. This process may be performed sequentially for all the rows 1 through n to store the data of one frame.

The clock signal driver 400 generates a set of clock signals CK for the generation of the plurality of gate signals S[1]-S[n] according to the third driving control signal CONT3 to be output to the gate driver 200. The third driving control signal CONT3 may include a clock pulse signal CPV described later with respect to FIG. 3. Each clock signal of the set of clock signals CK is a signal of which the gate-on voltage and the gate-off voltage are repeated with a constant period.

As explained further in the description to follow, the clock signal driver 400 receives a plurality of feedback clock signals CKF from the gate driver 200. The plurality of feedback clock signals CKF are signals of which the set of clock signals CK applied to the gate driver 200 are fed back to the clock signal driver 400. That is, the feedback clock signals CKF are derived from the set of clock signals CK. The clock signal driver 400 compares values of the feedback clock signals CKF with each other, and based on the comparison, controls the amplitudes of the clock signals CK so that the amplitude difference between the feedback clock signals CKF is less than a reference value (threshold). The value of a feedback clock signal CKF may be a current value flowing in a clock line CKL1 or CKL2 (described later with respect to FIG. 2) when the feedback clock signal CKF coincides with the gate-on voltage. Alternatively, the value of a feedback clock signal CKF may be a voltage value of a clock line CKL1 or CKL2 when the feedback clock signal CKF coincides with the gate-on voltage.

The clock signal driver 400 may generate a first power supply voltage VDD and a second power supply voltage VSS for the driving of the gate driver 200 to be transmitted to the gate driver 200. According to an exemplary embodiment, the clock signal driver 400 may transmit only one of the first power supply voltage VDD and the second power supply voltage VSS to the gate driver 200.

The clock signal driver 400 will be described in detail with reference to FIG. 3.

Figure 2:
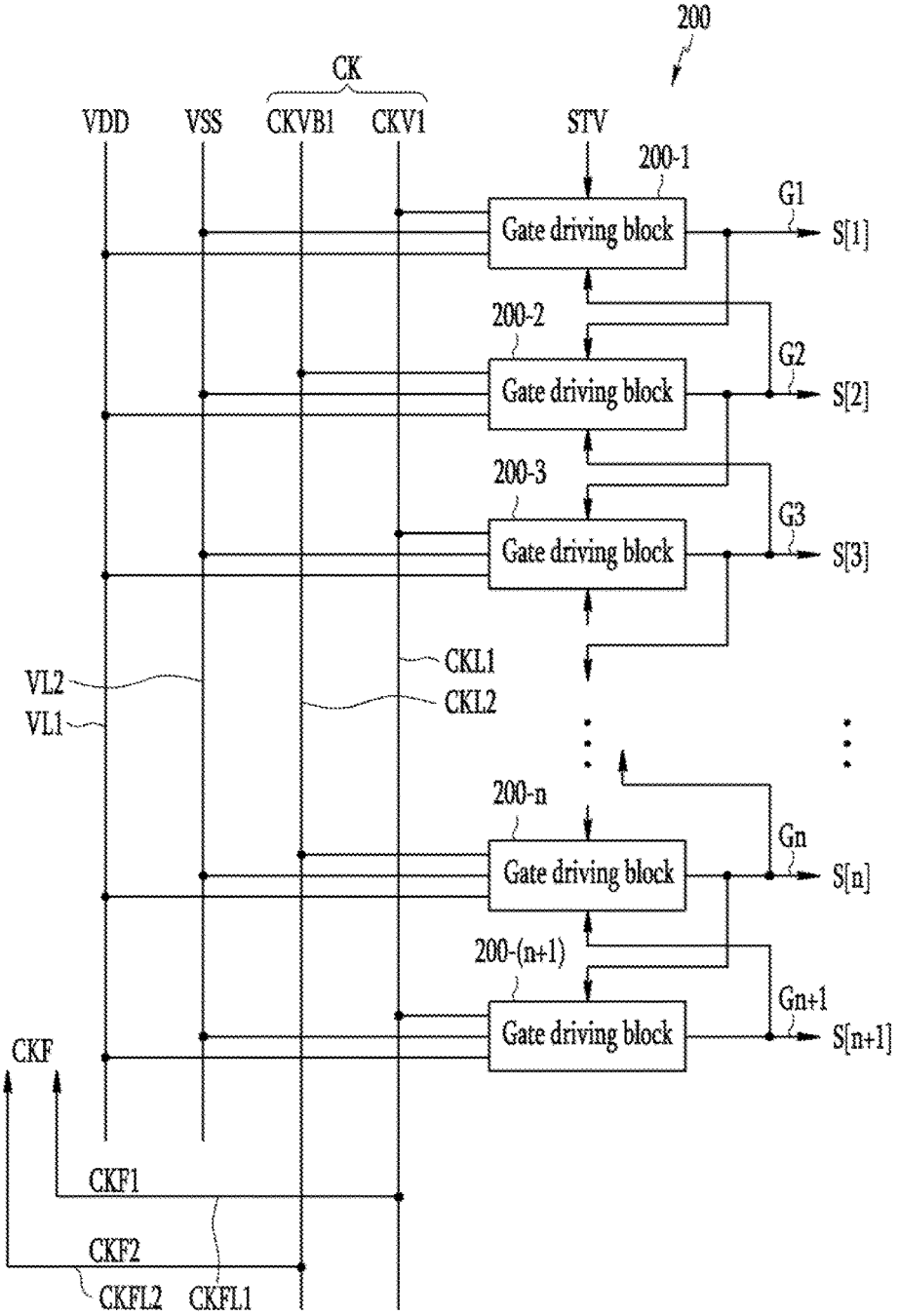
FIG. 2 schematically illustrates an example gate driver of a display device according to an exemplary embodiment.

FIG. 2 schematically illustrates a gate driver 200 of a display device according to an exemplary embodiment. The gate driver 200 includes a plurality of gate driving blocks (circuits) 200-1, 200-2, 200-3, . . . , **200-*n*, and 200-(*n*+1)**.

Each of the plurality of gate driving blocks 200-1, 200-2, 200-3, . . . , **200-*n*, and 200-(*n*+1) is connected to a first power supply line VL1 and a second power supply line VL2, thereby receiving the first power supply voltage VDD and the second power supply voltage VSS through the first power supply line VL1 and the second power supply line VL2. In other embodiments, one of the first power supply line VL1 and the second power supply line VL2 may be omitted, and each of the plurality of gate driving blocks 200-1, 200-2, 200-3, . . . , 200-*n*, and 200-(*n*+1) may receive only one of the first power supply voltage VDD and the second power supply voltage VSS. (Power supply lines VL1, VL2 and clock lines CKL1, CKL2 may be considered part of display device 10 in between clock signal driver 400 and gate driver 200. Alternatively, power supply lines VL1, VL2 and clock lines CKL1, CKL2 are considered part of gate driver 200 or part of clock signal driver 400**.)

A set of clock signals CK may include first and second clock signals CKV1 and CKVB1. The first clock signal CKV1 may be applied to the first clock line CKL1, and the second clock signal CKVB1 may be applied to the second clock line CKL2. The second clock signal CKVB1 may be a clock signal of an inverted phase with respect to that of the first clock signal CKV1. As mentioned earlier, the application of alternating clock signals with opposite phases to sequential rows may allow for alternating polarity voltages to be applied to the gate lines, which may avoid deterioration of LCD or LED characteristics.

Each of the plurality of gate driving blocks 200-1, 200-2, 200-3, . . . , **200-*n*, and 200-(*n*+1) may be connected to only one of the first clock line CKL1 and the second clock line CKL2. For example, as shown in FIG. 2, the odd-numbered gate driving blocks 200-1, 200-3, . . . , and 200-($n$+1) may be connected to the first clock line CKL1, and the even-numbered gate driving blocks 200-2, . . . , and 200-$n$ may be connected to the second clock line CKL2**.

The plurality of gate driving blocks 200-1, 200-2, 200-3, . . . , 200-$n$, and 200-($n$+1) may be connected to the plurality of gate lines G1, G2, G3, . . . , Gn, and G(n+1), respectively. The first gate line G1 to the n-th gate line Gn among the plurality of gate lines G1, G2, G3, . . . , Gn, and G(n+1) may be connected to the plurality of pixels. The (n+1)-th gate line G(n+1) of the final row may be a dummy gate line that is not connected to a pixel. Also, the (n+1)-th gate driving block 200-($n$+1) connected to the (n+1)-th gate line G(n+1) may be a dummy gate driving block that does not apply the gate signal S[n+1] to a pixel. In FIG. 2, one dummy gate line and one dummy gate driving block are described as an example. In other embodiments, two or more dummy gate lines and two or more dummy gate driving blocks may be provided. In still other embodiments, the dummy gate line and the dummy gate driving block may be omitted.

The plurality of gate driving blocks 200-1, 200-2, 200-3, . . . , 200-$n$, and 200-($n$+1) may sequentially output the plurality of gate signals S[1], S[2], S[3], . . . , S[n], and S[n+1] in synchronization with the clock signals CKV1 and CKVB1. The first gate driving block 200-1 may output the first gate signal S[1] of the gate-on voltage to the first gate line G1 in synchronization with the first clock signal CKV1 and the gate start signal STV. Also, the second gate driving block 200-2 may output the second gate signal S[2] of the gate-on voltage to the second gate line G2 in synchronization with the second clock signal CKVB1 and the first gate signal S[1]. In this case, the second gate signal S[2] may be fed back to the first gate driving block 200-1, and the first gate driving block 200-1 may output the first gate signal S[1] of the gate-off voltage in response to the second gate signal S[2]. The third gate driving block 200-3 may output the third gate signal S[3] of the gate-on voltage to the third gate line G3 in synchronization with the first clock signal CKV1 and the second gate signal S[2]. In this case, the third gate signal S[3] may be fed back to the second gate driving block 200-2, and the second gate driving block 200-2 may in response output the second gate signal S[2] of the gate-off voltage to the third gate signal S[3]. By this method, the plurality of gate driving blocks 200-1, 200-2, 200-3, . . . , 200-$n$, and 200-($n$+1) may sequentially output the plurality of gate signals S[1], S[2], S[3], . . . , S[n], and S[n+1]) of the gate-on voltage to the plurality of gate lines G1, G2, G3, . . . , Gn, and G(n+1).

The first feedback clock line CKFL1 may be connected to the first clock line CKL1, and the second feedback clock line CKFL2 may be connected to the second clock line CKL2. The first clock signal CKV1 and the second clock signal CKVB1 may be applied to the first clock line CKL1 and the second clock line CKL2 at a position adjacent to the first gate driving block 200-1. In this case, the first feedback clock line CKFL1 and the second feedback clock line CKFL2 may be connected to the first clock line CKL1 and the second clock line CKL2, respectively at a position proximate to the (n+1)-th gate driving block 200-($n$+1). That is, the first feedback clock line CKFL1 and the second feedback clock line CKFL2 may be connected to the first clock line CKL1 and the second clock line CKL2 at a position proximate to the dummy gate driving block.

Accordingly, the first clock signal CKV1 is applied to the first feedback clock line CKFL1 through the first clock line CKL1. Further, the second clock signal CKVB1 is applied to the second feedback clock line CKFL2 through the second clock line CKL2. The first feedback clock line CKFL1 and the second feedback clock line CKFL2 are connected to the clock signal driver 400. The first clock signal CKV1 and the second clock signal CKVB1 transmitted through the first feedback clock line CKFL1 and the second feedback clock line CKFL2 are applied to the clock signal driver 400 as the plurality of feedback clock signals CKF.

In this case, the first clock signal CKV1 transmitted through the first feedback clock line CKFL1 may have a current value flowing to a node to which the first feedback clock line CKFL1 and the first clock line CKL1 are connected when the first clock signal CKV1 is the gate-on voltage. This current value may vary as a function of the resistance of the first clock line CKL1. Also, the first clock signal CKV1 transmitted through the first feedback clock line CKFL1 may have a voltage value of the node to which the first feedback clock line CKFL1 and the first clock line CKL1 are connected when the first clock signal CKV1 generates the gate-on voltage, and this voltage value may vary as a function of the resistance of the first clock line CKL1. For instance, in the absence of a feedback resistance control scheme as discussed below, the first clock signal CKV1 may have a peak amplitude substantially equal to that of CVB1 (if measured near the input points), but the resistance of the first clock line CKL1 may differ excessively from that of the second clock line CKL2. In this case, gate lines such as G1 and G2 that are close to the circuit points at which the clock signals are input, may output satisfactory gate signals S[1] and S[2]. This is because the resistance deviation along the short circuit path to the respective gate driving blocks is not large enough to negatively impact the gate signals. However, for gate lines further away from the input points, such as gate lines Gn and G(n−1), the cumulative resistance difference along the larger circuit path becomes significant, such that the image quality in that part of the display may deteriorate as the clock signals applied to the far end gate drivers differ in amplitude. The present embodiment may prevent this sort of deterioration by first determining a resistance imbalance condition between the clock lines by comparing the amplitudes of the feedback clock signals CKF. If the resistance imbalance is above a threshold, an amplitude adjustment of the input clock signals CKV1 and CKVB1 is made by attenuating one of the input clock signals relative to the other. To this end, a selective attenuation scheme using a bank of resistors may be used, as discussed below.

In the embodiment of FIG. 2, one first clock line CKL1 and one second clock line CKL2 are described as an example. In other embodiments, a plurality of first clock lines CKL1 may be provided, and a plurality of first clock signals CKV1 having different periods from each other, different phases from each other, or different duty ratios from each other may be applied to a plurality of first clock lines CKL1, respectively. Further, the same number of second clock lines CKL2 as the first clock lines CKL1 may be provided, and a plurality of second clock signals CKVB1 having different periods from each other, different phases from each other, or different duty ratios from each other may be applied to a plurality of second clock lines CKL2. In this case, the plurality of gate driving blocks 200-1, 200-2, 200-3, . . . , 200-$n$, and 200-($n$+1) may be connected to sections among the plurality of first clock lines CKL1 and the plurality of second clock lines CKL2.

The first feedback clock lines CKFL1 may be provided with the same number as the plurality of first clock lines CKL1 to be connected to the plurality of first clock lines CKL1, and the second feedback clock lines CKFL2 may be provided with the same number as the plurality of second clock lines CKL2 to be connected to the plurality of second clock lines CKL2, respectively.

Figure 3:
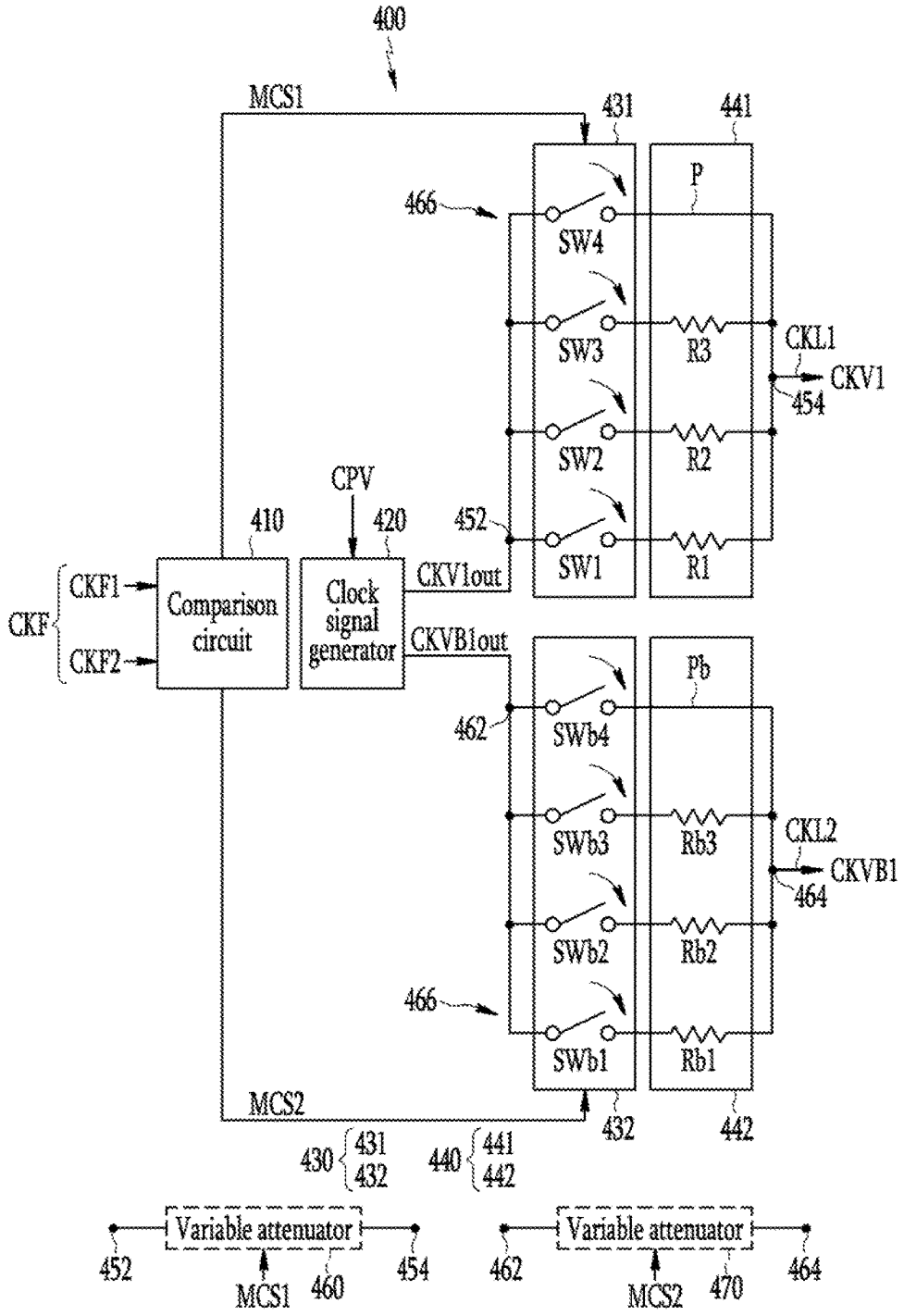
FIG. 3 schematically depicts a clock signal driver of a display device according to an exemplary embodiment.

FIG. 3 schematically depicts a clock signal driver of a display device according to an exemplary embodiment. Clock signal driver 400 includes a comparison circuit 410, a clock signal generator 420, a multiplexer circuit (MUX) 430, and a resistor bank 440.

The comparison circuit 410 receives the plurality of feedback clock signals CKF through the first feedback clock line CKFL1 and the second feedback clock line CKFL2. The plurality of feedback clock signals CKF include a first feedback clock signal CKF1 and a second feedback clock signal CKF2.

The comparison circuit 410 compares the first current value of the first feedback clock signal CKF1 and the second current value of the second feedback clock signal CKF2 to calculate the amplitude difference between the two currents. The first current value may be the current value of the first feedback clock signal CKF1 when the first feedback clock signal CKF1 pulse coincides with the gate-on voltage. The second current value may be the current value of the second feedback clock signal CKF2 when the second feedback clock signal CKF2 pulse coincides with the gate-on voltage. The comparison circuit 410 may determine whether the calculated difference exceeds a predetermined threshold, and may generate MUX control signals MCS1 and MCS2 depending on the result thereof.

Alternatively, comparison circuit 410 compares a first voltage of the first feedback clock signal CKF1 with a second voltage of the second feedback clock signal CKF2 to calculate the difference, and the above operations described with respect to current are performed in an analogous manner using the first and second voltages. The first and second voltages correspond to gate-on voltage conditions on the respective first and second clock lines, analogously.

When the difference in current or voltage between the feedback clock signals CKF1, CKF2 exceeds the threshold, the MUX control signals MCS1, MCS2 are commands designed to reduce the difference to an amount below the threshold. To this end, first and second signal controlled variable attenuators 460, 470 may be used to separately attenuate a respective clock signal. A clock signal generator 420 outputs a clock signal CKV1out which is passed through first variable attenuator 460 to become the first clock signal CKV1. The amount of attenuation of signal CKV1out, if any, is controlled by control signal MCS1. Clock signal generator 420 also outputs a clock signal CKVB1out which is routed through second variable attenuator 470 to become the second clock signal CKVB1. The amount of attenuation of signal CKVB1 is controlled by control signal MCS2. Each variable attenuator 460, 470 may be formed by a combination of switches (431 or 432) and resistors (441 or 442, respectively) discussed hereafter.

The clock signal generator 420 generates first output clock signal CKV1out and second output clock signal CKVB1out according to the clock pulse signal CPV applied from the signal controller 100. The clock pulse signal CPV is a signal such that the high level voltage and the low level voltage forming the clock pulses are repeated with a constant cycle. The second output clock signal CKVB1out may be the clock signal of the inverted phase with respect to that of the first output clock signal CKV1out.

In FIG. 3, one clock pulse signal CPV is illustrated, however a plurality of clock pulse signals CPV may be provided according to other exemplary embodiments, and the plurality of clock pulse signals CPV may have different cycles, different phases, or different duty ratios from each other. The clock signal generator 420 may generate the plurality of first output clock signals CKV1out having the different cycles, phases or duty ratios from each other according to the plurality of clock pulse signals CPV. Also, the clock signal generator 420 may generate the plurality of second output clock signals CKVB1out as the clock signal of the inverted phase with respect to that of the plurality of first output clock signals CKV1out.

A "MUX unit" 430 includes a first MUX unit 431 and a second MUX unit 432. The first MUX unit 431 includes a plurality of first switches SW1, SW2, SW3, and SW4 coupled in parallel. Each of the plurality of first switches SW1, SW2, SW3, and SW4 includes one end connected to the clock signal generator 420, and the first output clock signal CKV1out may be selectively routed through one of the plurality of first switches SW1, SW2, SW3, and SW4. Note that a parallel arrangement of switches such as illustrated at 431, 432 is referred to herein as a "MUX unit" since it is considered to receive multiple input signals and provide one output therefrom at any given time. That is, for MUX unit 431, the signal CKV1out is split into multiple signals by a 1:4 splitter 466 at node 452 and each of the split signals is applied to an input port at one of the switches SW1, SW2, SW3 or SW4. MUX unit 431, splitter 466, and resistor bank 441 together form the first variable attenuator 460 between nodes 452 and 454. The switch arrangement 432 is denoted a "MUX unit 432" based on the same principle, and forms part of the second variable attenuator 470 between nodes 462 and 464.

The plurality of first switches SW1, SW2, SW3, and SW4 may be selectively turned on by the first MUX control signal MCS1 output from the comparison circuit 410, and the first output clock signal CKV1out may be transmitted to the resistor bank 440 through one turned-on first switch among switches SW1, SW2, SW3, and SW4. In alternative embodiments, two or more switches may be turned on and the signals routed through two or more respective resistors, so as to provide more resistance variation possibilities.

The second MUX unit 432 includes a plurality of second switches SWb1, SWb2, SWb3, and SWb4 coupled in parallel. Each of the plurality of second switches SWb1, SWb2, SWb3, and SWb4 has an input end connected to the clock signal generator 420, and the second output clock signal CKVb1out may be output to the plurality of second switches SWb1, SWb2, SWb3, and SWb4. The plurality of second switches SWb1, SWb2, SWb3, and SWb4 may be selectively turned on by the second MUX control signal MCS2 output from the comparison circuit 410, and the second output clock signal CKVb1out may be routed to the resistor bank 440 through one of the turned-on second switches SWb1, SWb2, SWb3, and SWb4.

The resistor bank 440 includes a first resistor bank 441 connected to the first MUX unit 431 and a second resistor bank 442 connected to the second MUX unit 432.

The first resistor bank 441 includes a plurality of first resistors R1, R2, and R3, and a direct (substantially zero resistance) connection path or node P, coupled in parallel. The plurality of first resistors R1, R2, and R3 may have different resistances from each other and are used for signal attenuation. The plurality of first resistors R1, R2, and R3 are connected to the other ends of the plurality of first switches SW1, SW2, and SW3, respectively. In this case, a number of the plurality of first resistors R1, R2, and R3 may be smaller than a number of the plurality of first switches SW1, SW2, SW3, and SW4 by one, and one first switch SW4 may be connected to the direct connection path P. First resistors R1, R2, and R3 and direct connection path P are connected to the first clock line CKL1 outputting the first clock signal CKV1. (The first switch SW4 may be considered directly to the first clock line CKL1 through the substantially zero resistance, direct connection path P).

The second resistor bank 442 includes a plurality of second resistors Rb1, Rb2, and Rb3 and a substantially resistance free, direct connection path or node Pb coupled in parallel. The plurality of second resistors Rb1, Rb2, and Rb3 may have different resistances from each other, and are likewise used for signal attenuation. Second resistors Rb1, Rb2, and Rb3 are connected to the other end of the plurality of second switches SWb1, SWb2, and SWb3. In this case, a number of the second resistors Rb1, Rb2, and Rb3 may be smaller than a number of the second switches SWb1, SWb2, SWb3, and SWb4, and one second switch SWb4 may be connected to the direct connection path Pb. Second resistors Rb1, Rb2, and Rb3 and the direct connection path Pb are connected to the second clock line CKL2 outputting the second clock signal CKVB1. (The second switch SWb4 may be considered directly connected to the second clock line CKL2 through the substantially zero resistance direct connection path Pb).

As the first switches SW1, SW2, SW3, and SW4 included in the first MUX unit 431 may be selectively turned on by the first MUX control signal MCS1, the first clock line CKL1 may be connected to the clock signal generator 420 through any one among the first resistors R1, R2, and R3 and the direct connection path Pb.

Further, as the plurality of second switches SWb1, SWb2, SWb3, and SWb4 included in the second MUX unit 432 may be selectively turned on by the second MUX control signal MCS2, the second clock line CKL2 may be connected to the clock signal generator 420 through any one among the plurality of second resistors Rb1, Rb2, and Rb3 and the direct connection path Pb.

When the difference between the first current value (or the first voltage value) and the second current value (or the second voltage value) is less than the predetermined threshold, the comparison circuit 410 transmits the first MUX control signal MCS1 to the first MUX unit 431 at a control value for turning on the first switch SW4 connected to the direct connection path P, and transmits the second MUX control signal MCS2 of the second MUX unit 432 to turn on the second switch SWb4 connected to the direct connection path Pb. Accordingly, the first output clock signal CKV1out output from the clock signal generator 420 is applied to the first clock line CKL1 substantially as is (without attenuation), as the first clock signal CKV1. Also, the second output clock signal CKVB1out output from the clock signal generator 420 is applied to the second clock line CKL2 substantially as is (without attenuation), as the second clock signal CKVB1.

When the difference between the first current value (or the first voltage value) and the second current value (or the second voltage value) exceeds the predetermined threshold, the comparison circuit 410 may turn on one among the switches SW1, SW2, SW3, SWb1, SWb2, and SWb3 connected to the resistors R1, R2, R3, Rb1, Rb2, and Rb3 in one of the first MUX unit 431 and the second MUX unit 432. The comparison circuit 410 may also turn on one of the switches SW4 and SWb4 connected to the direct connection path P or Pb in the other one of the first MUX unit 431 and the second MUX unit 432.

For example, when the first current value is less than the second current value by more than the threshold, the first MUX control signal MCS1 is output to the first MUX unit 431 at a control value for turning on the first switch SW4 connected to the direct connection path P so that the first output clock signal CKV1out is applied to the first clock line CKL1 substantially without attenuation as the first clock signal CKV1. In addition, the comparison circuit 410 transmits the second MUX control signal MCS2 to the second MUX unit 432 at a control value for turning on one among the second switches SWb1, SWb2, and SWb3 connected to the second resistors Rb1, Rb2, and Rb3 so that the second output clock signal CKVB1out is applied to the second clock line CKL2 through any one among the second resistors Rb1, Rb2, and Rb3. In this case, the comparison circuit 410 may select one of the second resistors Rb1, Rb2, and Rb3 corresponding to a magnitude of the difference beyond the threshold. For instance, if Rb1<Rb2<Rb3 and the current or voltage difference beyond the threshold is within a smallest preset range, the resistor Rb1 is selected (switch SWb1 controlled closed while the other switches in MUX 432 are controlled open). If the current or voltage difference beyond the threshold is measured as within a largest preset range, the resistor Rb3 is selected. The current value is reduced through the selected one among the second resistors Rb1, Rb2, and Rb3 such that the second output clock signal CKVB1out generated in the clock signal generator 420 is applied to the second clock line CKL2 as the second clock signal CKVB1. Similar control operations to those above are performed in the case of the second clock signal current/voltage being less than the first clock signal current/voltage by more than the threshold (i.e., selecting a resistor within resistor bank 441 based on the amount of the difference).

Accordingly, after the above-described adjustment attenuating the input clock signal using the selected resistor(s), the difference between the first and second current values of the first and second feedback clock signals CKF1 and CKF2, respectively, may be less than the threshold. That is, substantially, the difference between the current value of the first clock signal CKV1 of the gate-on voltage, and the current value of the second clock signal CKVB1 of the gate-on voltage, flowing out of the first clock line CKL1 and the second clock line CKL2, may be less than the threshold. In the case of a current measurement, the added resistance lowers the overall current flow into and out of that clock line, since the clock signals CKV1out and CVKB1out should be output at the same voltages regardless of the resistor selected.

Likewise, in the case of a voltage measurement, the comparison circuit 410 may compare the voltage of the first feedback clock signal CKF1 and the voltage of the second feedback clock signal CKF2, and in this case, the difference between the voltage of the first clock signal CKV1 of the gate-on voltage and the voltage of the second clock signal CKVB1 of the gate-on voltage, near the ends of the first clock line CKL1 and the second clock line CKL2, may be substantially reduced to be less than a voltage threshold.

It is noted here (refer again to FIG. 2) that both the difference threshold, and the values of the resistors (R1, R2, R3) and (Rb1, Rb2, Rb3) should not be preset to values that would cause too great an imbalance in voltage between the near ends of the clock lines CKL1, CKL2, i.e., near the gate lines G1, G2. In other words, it is undesirable to have a large imbalance in voltage at the near ends of the clock lines CKL1, CKL2 if such an imbalance results in image artifacts on the display. This holds true even if image artifacts on the far end of the display, i.e., by gate lines G(N−1) and GN, are resolved with a resistor selection scheme that substantially equalizes the voltages measured at the far end. (The voltage drop from the near end to the far end of one clock line may differ from the voltage drop from the near end to the far end of another clock line, causing an imbalance in the first place when resistances of the clock lines differ excessively). Therefore, the values of the threshold and the resistor values should be preset accordingly to avoid a voltage imbalance condition that introduces unsuitable image artifacts on the near end of the display even if eliminating the image artifacts on the far end of the display.

It should be noted that in other embodiments, the number of the plurality of first switches SW1, etc., included in the first MUX unit 431, the number of the plurality of second switches SWb1, etc. included in the second MUX unit 432, the number of first resistors R1, etc., and the number of second resistors Rb1, etc., may be more or fewer than those illustrated in FIG. 3. Further, the clock signal driver 400 including the first and second MUX units 431 and 432 and the first and second resistor banks 441 and 442 corresponding to the first clock signal CKV1 and the second clock signal CKVB1 is illustrated in the embodiment of FIG. 3. In other embodiments, the number of MUX units 430 and the number of resistor banks 440 may be larger, and may be determined according to the number of clock signals generated in the clock signal generator 420.

Next, a display device according to another exemplary embodiment of the present invention will be described with reference to FIG. 4 and FIG. 5. For brevity, differences from the display device 10 according to the exemplary embodiment described in FIG. 1 to FIG. 3 will be mainly described.

Figure 4:
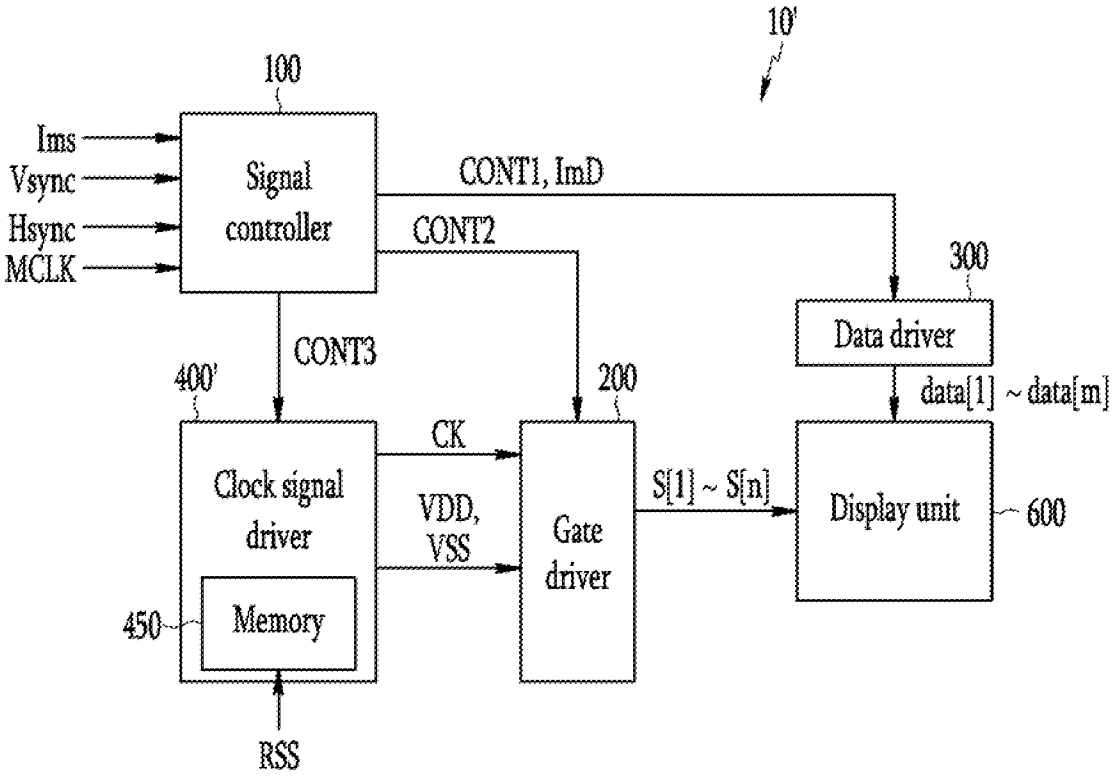
FIG. 4 is a block diagram schematically showing a display device according to another exemplary embodiment of the present disclosure.

FIG. 4 is a block diagram schematically showing a display device 10' according to another exemplary embodiment of the present disclosure. FIG. 5 schematically illustrates an example clock signal driver that may be used in this embodiment.

Figure 5:
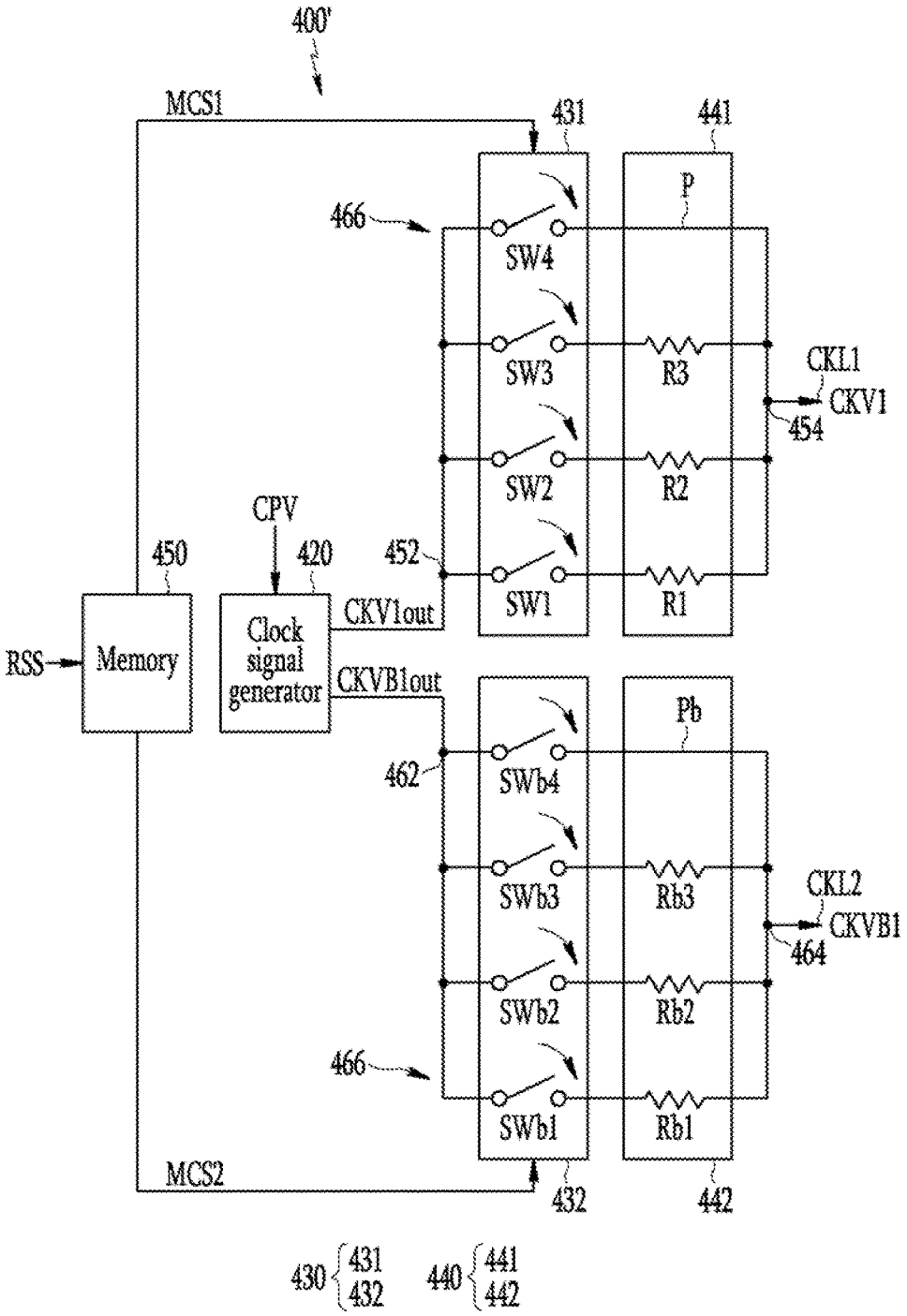
FIG. 5 schematically illustrates an example clock signal driver that may be used in the embodiment of FIG. 4.

Referring to FIGS. 4 and 5, the display device 10' includes a signal controller 100, a gate driver 200, a data driver 300, a clock signal driver 400', and a display unit 600, and the clock signal driver 400' includes a memory 450. In other embodiments, the memory 450 is not included in the clock signal driver 400', but may be separately provided.

Compared with the display device 10 of FIG. 1 to FIG. 3, the clock signal driver 400' may not receive the feedback clock signals CKF from the gate driver 200.

The memory 450 stores a plurality of resistance selection values and receives a resistor selection signal RSS. The resistance selection value is a control value that instructs which switch is to be turned on among the first switches SW1, SW2, SW3, and SW4 included in the first MUX unit 431 and the second switches SWb1, SWb2, SWb3, and SWb4 included in the second resistor bank 442. That is, the resistance selection value may be a value for selecting the resistor connected to the clock signal generator 420. The resistor selection signal RSS may be a user initiated signal received through a user interface. For instance, the user interface may offer the user a selection option to select a resistor setting for changing the display appearance, such as a setting particularly tailored to reducing image artifacts. The memory 450 may output the first MUX control signal MCS1 to be routed to the first MUX unit 431 based on the value selected by the resistor selection signal RSS among the plurality of resistance selection values. The memory 450 may output the second MUX control signal MCS2 to be routed to the second MUX unit 432 based on the value selected by the resistor selection signal RSS among the plurality of resistance selection values.

The memory 450 may be a nonvolatile memory such as an electrically erasable programmable read-only memory (EEPROM).

The first MUX unit 431 may turn on any one among the plurality of first switches SW1, SW2, SW3, and SW4 according to the first MUX control signal MCS1 to connect the clock signal generator 420 to the first clock line CKL1 through any one among the plurality of first resistors R1, R2, and R3 or to be connected directly to the first clock line CKL1 without going through the plurality of first resistors R1, R2, and R3.

The second MUX unit 432 may turn on any one among the plurality of second switches SW1, SW2, SW3, and SW4 according to the second MUX control signal MCS2 to connect the clock signal generator 420 to the second clock line CKL2 through any one among the plurality of second resistors Rb1, Rb2, and Rb3 or to be connected directly to the second clock line CKL2 without going through the second resistors Rb1, Rb2, and Rb3.

As described above, by using the memory 450 including the plurality of resistance selection values and the resistor selection signal RSS, the current value (or the voltage value) of the first clock signal CKV1 of the gate-on voltage and the current value (or the voltage value) of the second clock signal CKVB1 of the gate-on voltage, flowing to the first clock line CKL1 and the second clock line CKL2, may be controlled. That is, the user may control the difference between the current values (or the voltage values) of the first clock signal CKV1 of the gate-on voltage and the current value (or the voltage value) of the second clock signal CKVB1 of the gate-on voltage, flowing out of the first clock line CKL1 and the second clock line CKL2, to be less than the threshold.

Except for these differences, the other characteristics of the exemplary embodiment described with reference to FIG. 1 to FIG. 3 may all be applied to the exemplary embodiment described with reference to FIGS. 4 and 5; thus, the description of other characteristics of the exemplary embodiment described in FIG. 1 to FIG. 3 is omitted for brevity.

Next, the display device according to another exemplary embodiment of the present disclosure will be described with reference to FIG. 6 and FIG. 7. Differences from the display device 10 according to the exemplary embodiment described in FIG. 1 to FIG. 3 and the display device 10' according to the exemplary embodiment described in FIG. 4 and FIG. 5 will be mainly described.

Figure 6:
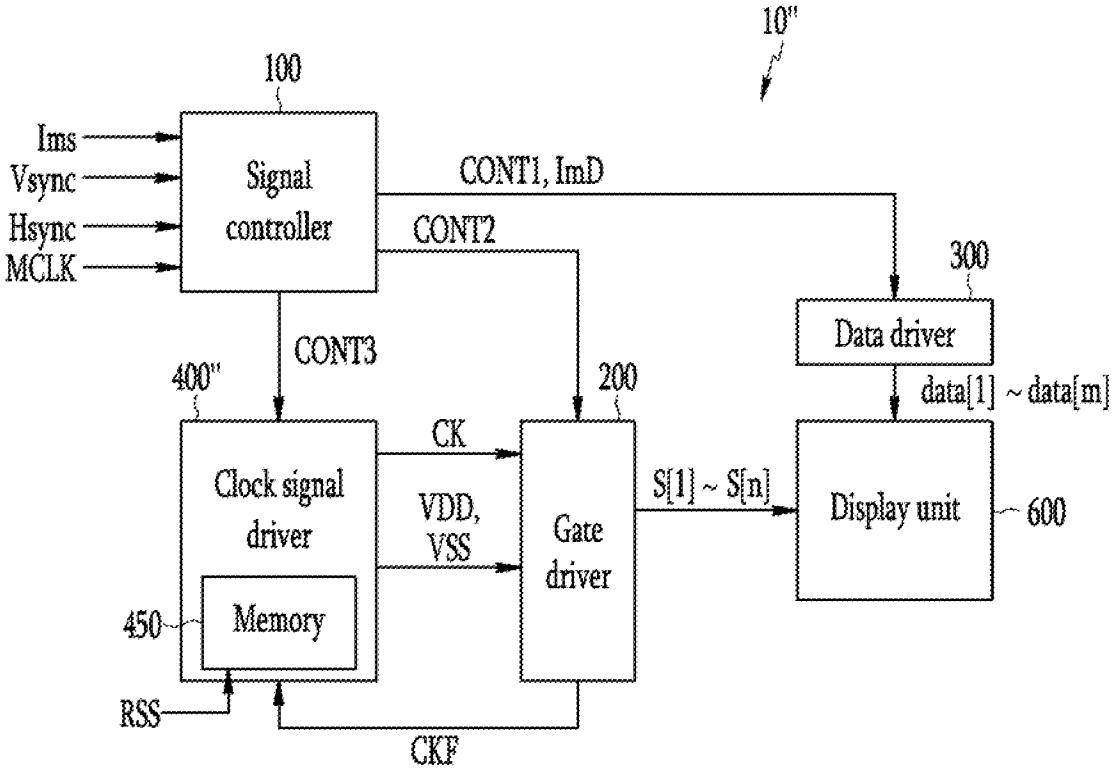
FIG. 6 is a block diagram schematically showing a display device according to still another exemplary embodiment of the present disclosure.

FIG. 6 is a block diagram schematically showing a display device 10" according to another exemplary embodiment of the present disclosure. FIG. 7 is a schematic diagram of an example clock signal driver of a display device that may be used in the embodiment of FIG. 6. Display device 10" includes the signal controller 100, the gate driver 200, the data driver 300, clock signal driver 400", and the display unit 600. Clock signal driver 400" includes the memory 450 and receives the feedback clock signals CKF from the gate driver 200.

The memory 450 receives the resistor selection signal RSS and generates a first MUX control signal MCS1 and a second MUX control signal MCS2 based on the resistor selection signal RSS. The memory 450 may output the first MUX control signal MCS1 to the first MUX unit 431 and the second MUX control signal MCS2 to the second MUX unit 432. The memory 450 may also output an inactive signal DS to the comparison circuit 410 if the resistor selection signal RSS is received to inactivate the comparison circuit 410.

The comparison circuit 410 receives the first feedback clock signal CKF1 and the second feedback clock signal CKF2 and compares the value of the first feedback clock signal CKF1 and the value of the second feedback clock signal CKF2, thereby generating a third MUX control signal MCS3 and a fourth MUX control signal MCS4 depending on the result thereof. The comparison circuit 410 outputs the third MUX control signal MCS3 to the first MUX unit 431 and the fourth MUX control signal MCS4 to the second MUX unit 432. The operation of the comparison circuit 410 is stopped when receiving the inactive signal DS from the memory 450, and may not generate the third MUX control signal MCS3 and fourth MUX control signal MCS4.

The first MUX unit 431 may turn on any one among the first switches SW1, SW2, SW3, and SW4 according to the first MUX control signal MCS1 or the third MUX control signal MCS3 to connect the clock signal generator 420 to the first clock line CKL1 through any one among the first resistors R1, R2, and R3 or to be connected directly to the first clock line CKL1 without the first resistors R1, R2, and R3.

The second MUX unit 432 may turn on any one among the second switches SW1, SW2, SW3, and SW4 according to the second MUX control signal MCS2 or the fourth MUX control signal MCS4 to connect the clock signal generator 420 to the second clock line CKL2 through any one among the second resistors Rb1, Rb2, and Rb3 or to be connected directly to the second clock line CKL2 without the second resistors Rb1, Rb2, and Rb3.

Except for these differences, the characteristics of the exemplary embodiment described with reference to FIGS. 1-3 and the exemplary embodiment described with reference to FIGS. 4-5 may all be applied to the exemplary embodiment described with reference to FIGS. 6 and 7 such that the description of the characteristics of the embodiments of FIGS. 1-5 are omitted for brevity.

Figure 7:
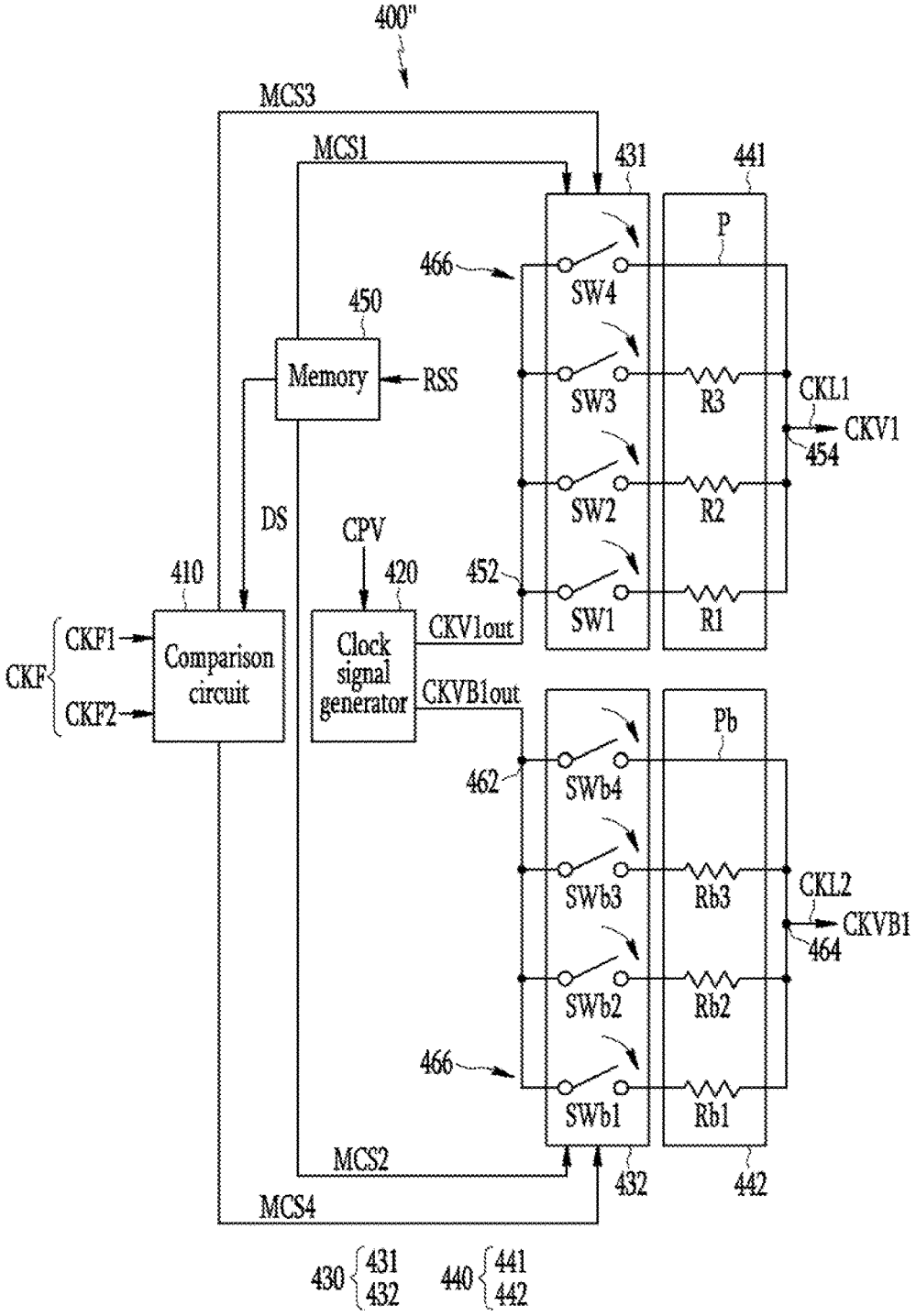
FIG. 7 is a schematic diagram of an example clock signal driver of a display device that may be used in the embodiment of FIG. 6.

In the above-described embodiments, at least first and second MUX units 431, 432 and first and second resistor banks 441, 442 as illustrated in FIGS. 3, 5 and 7 is employed in each configuration. However, it is contemplated that only a single MUX circuit and a single resistor bank may be employed in alternative embodiments. For instance, in the case where only MUX unit 431 and resistor bank 441 is used and MUX unit 432/resistor bank 442 are omitted, additional switching circuitry may be employed both in between the clock signal generator 420 and MUX unit 431, and in between the output node of resistor bank 441 and the first and second clock lines CKL1, CKL2. The additional switching circuitry is controlled to ensure that only a selected one of the output clock signals CKV1out or CKVB2out is attenuated by a resistor of the resistor bank, while the other is routed through a direct connection path to the clock line without attenuation, or that neither of the output clock signals is attenuated. The opening/closing of the additional switches may be controlled as necessary for the feedback clock signals to differ by less than the threshold. In an exemplary embodiment of this type with additional switches, two additional switches may be provided on the input side of MUX unit 431, and two additional switches may be provided on the output side of resistor bank 441, to realize desired switching. The overall configuration may omit the resistors of resistor bank 442 while achieving the same or similar ends as the embodiments described above.

Various elements described above in terms of a "unit" or function of the like may be comprised of hardware circuitry or firmware, and may alternatively by referred to as a "circuit", "circuitry", "hardware" or other technical term known to define the type of the element. For instance, any of the MUX units may be interchangeably called a MUX circuit or circuitry, and the display unit may be called a display. As another example, any of the above-described gate driver, data driver, signal controller, clock signal driver, clock signal generator, and variable attenuator may alternatively be termed gate driver circuitry, data driver circuitry, signal controller circuitry, clock signal driver circuitry, clock signal generator circuitry, and variable attenuator circuitry, or the like, respectively.

The above detailed descriptions with reference to the accompanying drawings are provided to assist in comprehensive understanding of exemplary embodiments of the claimed subject matter as defined by the appended claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. Therefore, the scope of the present invention shall be determined according to the attached claims and the equivalents thereof.

What is claimed is:

1. A display device comprising:

a plurality of pixels;

a gate driver configured to generate and apply a plurality of gate signals to a respective plurality of gate lines connected to the plurality of pixels, the gate signals being generated by using clock signals received by the gate driver; and a clock signal driver configured to output the clock signals and receive feedback clock signals derived from the clock signals, compare the feedback clock signals, and control amplitudes of the clock signals so that an amplitude difference between the feedback clock signals is less than a threshold.

2. The display device of claim 1, wherein the clock signal driver compares the feedback clock signals by comparing current or voltage values therebetween, each current or voltage value being determined at a time when an associated one of the feedback clock signals coincides with a gate-on voltage.

3. The display device of claim 1, wherein the clock signal driver outputs the clock signals to respective clock lines at near ends thereof, receives the feedback clock signals flowing from far ends of the clock lines, and the gate driver comprises a plurality of gate driver circuits each connected between one clock line and one gate line and receiving one of the clock signals at a region in between the near ends and far ends of the clock lines.

4. The display device of claim 1, further comprising clock lines respectively carrying the clock signals, and wherein the clock signal driver includes:

a comparison circuit configured to receive a first feedback clock signal and a second feedback clock signal from the clock lines and to compare a first current or voltage value of the first feedback clock signal and a second current or voltage value of the second feedback clock signal with each other to generate a multiplexer (MUX) control signal;

a clock signal generator generating a first output clock signal;

a first resistor bank including a plurality of first resistors; and a first MUX unit connecting the clock signal generator at a node providing the first output clock signal, to a first clock line of the clock lines connected to the gate driver through any one among the plurality of first resistors and a first direct connection path, according to the MUX control signal, and thereby provide a first clock signal of the clock signals on the first clock line.

5. The display device of claim 4, wherein the clock signal driver generates a second output clock signal and further includes:

a second resistor bank including a plurality of second resistors; and a second MUX unit connecting the clock signal generator, at a node providing the second output clock signal, to a second clock line of the clock lines connected to the gate driver through any one among the plurality of second resistors and a second direct connection path, according to a second MUX control signal output from the comparison circuit, and thereby provide a second clock signal of the clock signals on the second clock line.

6. The display device of claim 5, wherein the second clock signal is a clock signal of an inverted phase with respect to that of the first clock signal.

7. The display device of claim 6, wherein the first clock signal is transmitted through the first clock line to be received by the comparison circuit as the first feedback clock signal derived from the first clock signal and having a current value that is dependent on a resistance of the first clock line, and the second clock signal is transmitted through the second clock line to be received by the comparison circuit as the second feedback clock signal derived from the second clock signal and having a current value that is dependent on resistance of the second clock line.

8. A display device comprising:

clock lines carrying different respective clock signals, for application to different respective gate lines;

a gate driver connected to the clock lines and configured to use the clock signals to generate and apply gate signals to respective gate lines connected to pixels; and a clock signal driver configured to output the clock signals to a first region of the clock lines, receive feedback clock signals flowing from a second region of the clock lines, compare current or voltage levels between the feedback clock signals, and control amplitudes of the outputted clock signals so that a current or voltage level difference between the feedback clock signals is less than a threshold.

9. The display device of claim 8, wherein the clock signal driver comprises:

comparison circuitry that compares the current or voltage levels between the feedback clock signals and outputs at least first and second control signals in accordance therewith; and at least first and second variable attenuators coupled between the comparison circuitry and at least first and second clock lines of the clock lines, respectively, wherein attenuation of the first variable attenuator is controlled according to the first control signal and attenuation of the second variable attenuator is controlled according to the second control signal.

10. A display device comprising:

a plurality of pixels;

a clock signal driver configured to output a plurality of clock signals; and a gate driver configured to use the clock signals to generate and apply a plurality of gate signals to a plurality of gate lines connected to the plurality of pixels;

wherein the clock signal driver includes:

a memory configured to store a plurality of resistance selection values and to output, responsive to a resistor selection signal, a multiplexer (MUX) control signal based on one of the resistance selection values selected according to the resistor selection signal;

a clock signal generator generating an output clock signal;

a resistor bank including a plurality of resistors; and

MUX circuitry routing the output clock signal to a clock line connected to the gate driver through any one among the plurality of resistors and a direct connection path, according to the MUX control signal.

11. The display device of claim 10, wherein the resistor selection signal is a user initiated signal received through a user interface.

12. The display device of claim 10, further comprising a line splitter coupled between the clock signal generator at a node at which the output clock signal is provided, and the MUX circuitry.

13. The display device of claim 12, wherein the MUX circuitry is first MUX circuitry, the MUX control signal is a first MUX control signal, the clock line is a first clock line, the direct connection path is a first direct connection path, and wherein:

the clock signal driver outputs a second MUX control signal and further includes:

a second resistor bank including a plurality of second resistors; and second MUX circuitry connecting the clock signal generator to a second clock line connected to the gate driver through any one among the plurality of second resistors and a second direct connection path, according to the second MUX control signal.

14. The display device of claim 13, wherein the clock signal generator generates a second output clock signal, and the second output clock signal is applied to the second clock line as a second clock signal of the plurality of clock signals through any one among the plurality of second resistors and the second direct connection path by the second MUX circuitry.

15. The display device of claim 14, wherein the second clock signal is a clock signal of an inverted phase with respect to that of the first clock signal.

16. The display device of claim 14, wherein the clock signal driver further includes:

a comparison circuit configured to receive a first feedback clock signal and a second feedback clock signal flowing from the first and second clock lines, respectively, and to compare a first current value of the first feedback clock signal and a second current value of the second feedback clock signal to generate a third MUX control signal and a fourth MUX control signal.

17. The display device of claim 16, wherein the first MUX circuitry connects the clock signal generator to the first clock line through any one among the plurality of first resistors and the first direct connection path according to the third MUX control signal.

18. The display device of claim 17, wherein the second MUX circuitry connects the clock signal generator to a second clock line connected to the gate driver through any one among the plurality of second resistors and the second direct connection path, according to the fourth MUX control signal.

19. The display device of claim 16, wherein the memory transmits an inactive signal to the comparison circuit if the resistor selection signal is received to inactivate the comparison circuit.

20. The display device of claim 16, wherein the first clock signal is transmitted through the first clock line to be received by the comparison circuit as the first feedback clock signal having a current or voltage value that is dependent on resistance of the first clock line, and the second clock signal is transmitted through the second clock line to be received by the comparison circuit as the second feedback clock signal having a current or voltage value that is dependent on resistance of the second clock line.

* * * * *